United States Patent [19]

Itoh et al.

[11] Patent Number: 4,741,286

[45] Date of Patent: May 3, 1988

[54] SINGLE TORCH-TYPE PLASMA SPRAY COATING METHOD AND APPARATUS THEREFOR

[75] Inventors: Tsutomu Itoh; Haruo Tateno, both of Tokyo; Hideo Nagasaka, Hitachi; Masahiro Yamamoto, Sakura; Yusuke Mitsuyoshi, Tokyo; Susumu Matsuno, Ichikawa; Hiroshi Saitoh, Funabashi; Masayuki Kitoh, Higashikurume, all of Japan

[73] Assignee: Onoda Cement Company, Ltd., Yamaguchi, Japan

[21] Appl. No.: 862,031

[22] Filed: May 12, 1986

[30] Foreign Application Priority Data

May 13, 1985 [JP] Japan ..... 60-101081

[51] Int. Cl.[4] ..... B05B 5/02

[52] U.S. Cl. ..... 118/620; 219/121 PM; 239/81; 427/34

[58] Field of Search ..... 427/34; 219/121 PM, 219/121 PP, 121 PQ, 121 PR, 121 PU; 239/79, 81, 85; 118/620

[56] References Cited

U.S. PATENT DOCUMENTS

| | | | |
|---|---|---|---|
| 3,628,079 | 12/1971 | Dobbs et al. | 219/121 PM |
| 3,900,639 | 8/1975 | Lauterbach | 427/34 |
| 4,024,373 | 5/1977 | Bykhovsky et al. | 219/121 PP |
| 4,032,744 | 6/1977 | Coucher | 219/121 PM |
| 4,146,654 | 3/1979 | Guyonnet | 427/34 |
| 4,596,918 | 6/1986 | Ponghis | 219/121 PM |

*Primary Examiner*—John H. Newsome

*Attorney, Agent, or Firm*—Price, Heneveld, Cooper, DeWitt & Litton

[57] ABSTRACT

A single torch-type plasma spray coating method wherein a gas flow in a nozzle of a plasma torch is made to be a laminer flow, thereby the plasma flame jetted from the end of the plasma torch is modified to be a laminer flow flame, the plasma is separated from the plasma flame which contains liquid droplets of molten spray coating material and runs toward an object to be worked by means for separating plasma arranged immediately before said object to be worked, and remaining droplets of molten spray coating material impinges on said object to form a coating film thereon, and an apparatus therefor.

19 Claims, 5 Drawing Sheets

SINGLE TORCH-TYPE PLASMA SPRAY COATING METHOD AND APPARATUS THEREFOR

FIELD AND BACKGROUND OF THE INVENTION

1. Field of the the Invention

This invention relates to improvements in the so-called plasma spray coating method and the apparatus therefor wherein a metal or a ceramic material is melted by means of a high-temperature plasma generated by electric arc, i.e. strong current through a gas, and is sprayed onto a substrate to form a strong coating film on a surface of substrate.

2. Description of the Prior Art

A plasma spray coating method and an apparatus therefor which have been broadly employed in the prior art are illustrated in FIG. 9 of the accompanying drawings. In the apparatus, a cathode 1 is held concentrically with a nozzle channel 25 of an anodic nozzle 2 by an insulator 12 so that the tip of the cathode may be placed near the entrance of the nozzle channel. Upstream, a plasma gas 8 is made to flow in via a charging port 7 for plasma gas.

The negative terminal of a power source 3 is connected to the cathode 1 by a conductor 5 and the positive terminal of the power source 3 is connected to the anodic nozzle 2 via an exciting power source 4 by a conductor 6. Reference numeral 6 depicts a cooling system. Usually, the anodic nozzle 2 has a double-walled structure (not shown) and the interior is arranged for being cooled always by a coolant, e.g. of soft water. When a D.C. voltage from a power source 3 is applied between the cathode and the anode and a high-frequency voltage is superposed by means of an exciting high-frequency power source 4 along with maintaining a flow of a plasma gas, usually an inert gas such as argon, through anodic nozzle 2 as shown by arrows 8 and 9, an electric arc 11 is generated from the tip of cathode 1 to the inner surface 105 of nozzle channel 25 of anodic nozzle 2. In this case, a short electric arc 11 tends to damage a wall 26 of nozzle channel 25, i.e. the inner wall of anodic nozzle 2. Accordingly, a large amount of plasma gas 8 is made to flow so that the generated electric arc may have as long a reach as possible within nozzle channel 25 to form an anode point 10 remote from the tip of cathode 1. Ths plasma gas flowing through nozzle channel 25 of anodic nozzle 2 is intensely heated to a high temperature by thus-formed arc 11, and jets out as so-called plasma state 16 from the forward end of anodic nozzle 2. Hereupon a spray coating material 18 is fed from a material charging pipe 17. The material is mixed with the plasma 16 of high temperature jetted from anodic nozzle 2, as shown by arrow 19, and forms instantly a molten material 20. Thus-formed molten material is sprayed onto a substrate 22 to form a coating film 21 thereon. In some cases, the spray coating material 18 from the material charging pipe 17 is fed at a point immediately before the outlet opening of anodic nozzle 2 or at a point immediately behind the outlet opening as shown by arrow 23.

In any cases of these plasma spray coating apparatuses employed in the prior art, an extremely large amount of gas is used for forming a long electric arc 11 within anodic nozzle 2, for preventing the erosion of wall 26 of nozzle channel 25, and for cooling the wall 26 of nozzle channel 25 by said plasma gas. The jetting speed of plasma gas leaving the outlet of anodic nozzle 2 is maintained at a very high value, usually in the range of Mach 05.–3.0. Due to this fact, a remarkably intense undesired sound of 110–120 phons is generated near the outlet opening of anodic nozzle 2. Therefore, plasma spray coating apparatuses of the prior art can be operated usually only in an isolated soundproof chamber. The operator cannot operate these plasma spray coating apparatuses without putting on a sound isolator. These are grave drawbacks in the prior art.

In addition, a plasma gas jetted from the outlet opening appears usually in the form of an extraordinarily bright flame. Thus, it is impossible to see directly said plasma gas. Accordingly, the operator of the apparatus is forced to put on ultraviolet protective goggles. On the other hand, usual plasma gases employable in plasma spray coating apparatus of the prior art are expensive inert gases, such as argon, helium and hydrogen. This is due to the fact that when a very active gas, such as air or oxygen, is used as plasma gas, the wall 26 of nozzle channel is oxidized to wear, especially at anode point 10, and the apparatus cannot be continuously operated for a long period of time. As these inert gases are expensive, a consumption of these gases in large amount for creating the high speed of the gas in said nozzle gives the disadvantage that the operating cost becomes quite high. In the prior plasma spray coating apparatus, the plasma gas 16 jetted from the front thereof forms an extremely turbulent flow because of remarkably high speed. Consequently, said gas flow involves a large amount of atmosphere near the jetting opening as shown by arrow 27. As a result, the temperature of plasma gas lowers rapidly. Thus, the conditions suitable for spray coating call for maintaining accurately the distance between the outlet opening of anodic nozzle 2 and the substrate 22. If the distance deviates from the accurate value, the shaping of the desired coating is quite difficult. In short, the quality control of the coating film requires a rigorous control of operational conditions. The quality control is achieved with difficulty.

Due to the situation detailed above, a large amount of high-speed gas is intensely blown against the substrate in the plasma spray coating apparatus of the prior art. Therefore, the substrate is limited to a material having high strength. Furthermore, no fine work can be performed.

One object of this invention is to provide a novel plasma spray coating apparatus wherein the drawback of the prior plasma spray coating apparatus which hinders the widespread use of the apparatus is removed.

Another object of this invention is to provide a plasma spray coating apparatus wherein the generation of an intense undesired sound is inhibited, the generation of a intense light including ultraviolet which allows no direct vision is inhibited, the extravagant consumption of expensive gas required for operation is saved, the control of operation conditions, such as the distance between the apparatus and the substrate, is not rigorous, the wear of parts is small, continuous operation can be achieved for a long period of time, a substrate having a relatively low strength can be worked, and fine work can be suitably performed.

SUMMARY OF THE INVENTION

In accordance with this invention, a rectifying device for plasma gas is provided between the tip of the cathode and a feed point of plasma gas in a plasma torch for spray coating. Along with this provision, the flow rate of a plasma gas is kept low. As a result, a gas stream within a nozzle of the forward part of a plasma torch is maintained in laminer flow state and the plasma flame generated therefrom is in laminer flow state. This is the first important feature of this invention. As for feeding of a spray coating material, the feeding is performed as in the prior art and the spray coating material is fed near the outlet of plasma torch. As the second important feature of this invention, the plasma is separated from a plasma flame which has liquid droplets of molten spray coating material therein and travles toward an object to be worked by means for separating the plasma arranged immediately before the object to be worked, and, immediately thereafter, droplets of molten spray coating material are permitted to impinge on the object for forming a coating film thereon. As means for separating plasma, generally applicable are methods effective for plasma separation, such as a method of blowing a gas into a plasma flame, a method of removing plasma from plasma flame absorption and a method combining use of blowing and absorption.

In the plasma spray coating in accordance with this invention, a flame sheath usually made of refractory material is arranged between the above-mentioned outlet of a plasma torch and means for separating plasma, if necessary. The plasma flame is enclosed with this sheath and the prevention of heat loss due to radiation is achieved. In this case, a thermal insulation device, a cooling device etc. are frequently used outside the flame sheath. Additionally, a device may be applied for feeding a gas suitable to the application to the plasma flame space formed within and through the flame sheath. Further, a device for modifying atmospheric gas can be arranged immediately after the means for separating plasma which is arranged in the proximity of the object to be worked. In addition, an intermediate part is installed in the nozzle of forward part of plasma torch. This intermediate part is kept in the electrically floating state during stationary operation for elongation of plasma arc.

In plasma spray coating according to this invention, the arc for generating plasma is maintained in laminer flow state by the rectifying device arranged upstream from the tip of the cathode and does not have a component perpendicular to the wall of anodic nozzle channel so that the arc can extend for a long distance along the nozzle channel. Because of this long range, the electric power is effectively consumed by the arc and the amount of power consumed at the anode point, i.e. the end point of arc on the wall of the nozzle channel, is small. Thus, the wear of the nozzle channel wall at the anode point becomes remarkably low. Accordingly, the cooling of the interior wall of nozzle by flowing the plasma gas at a great flow rate is not required in contrast to the spray coating apparatus of the prior art. As a result, as the plasma gas of low flow rate is run as a laminer flow and is effectively heated, the generated plasma is of high temperature and has a high enthalpy. Thereby, the melting of a spray coating material which is fed to plasma flame at the outlet of torch is achieved securely and rapidly. The temperature of liquid droplets of molten spray coating material is also high. The plasma flame jetted from plasma torch constitutes a laminer flow flame and the value of the undesired sound caused by the generation of plasma flame can be easily kept low in the range of 70–80 phons.

In the plasma spray coating according to this invention, the operation can be performed with an arc current of considerable value in spite of a low flow rate of plasma gas. Additionally, the arc is long. Thus, the potential difference between the starting point and the end point of arc, that is, the arc voltage can take a high value. Eventually, the electric power effectively consumed by the arc which is defined by the product of arc current and arc voltage takes a high value. As a result, the generated plasma is of very high temperature and has a very high enthalpy. Thereby, melting of spray coating material is ensured to realize the laminer flow plasma flame utilized in the spray coating of this invention involves scarcely the surrounding gas in the course of running. Accordingly, the decrease in temperature is very small. As the spray coating material which has been converted to liquid droplets by melting is entrained by the above-mentioned laminer flow flame and travels straight toward the object to be worked, the temperature of the spray coating material is scarcely lowered during travel. At a point proximate to the object to be spray coated, the plasma is separated. Then, the droplets impinge on the object to be spray coated after a short without lowering of the temperature. Consequently, although the velocity of liquid droplets is as low as a decimal fraction of that in the prior spray coating, a very firm coating film of high quality can be obtained, as the spray coating material, in the form of liquid droplets at high temperature due to the above-mentioned facts, collides with the substrate. Further, in the spray coating of this invention, an object to be spray coated is subject to no strong force and the object having low strength also can be easily spray coated, because the plasma flame employed in spray coating is of laminer flow with a low degree of spread and the velocity of plasma flame is low. Moreover, it is possible to work a delicate substrate with plasma spray coating.

In the plasma spray coating according to this invention, a flame sheath is arranged in the periphery of the plasma flame extending from the torch to the object to be spray coated, when requested. Thereby, the intensely bright light including ultraviolet rays emitted from the plasma flame can be cut off, and further the heat loss due to radiation from the plasma flame can be prevented. Thus, the lowering of the temperature in plasma flame and spray coating material is inhibited. These facts also contribute much to obtaining a coating film of high quality.

In the plasma spray coating of this invention, the melting of spray coating material is completed within a very short period of time as the plasma flame fed with spray coating material is at a high temperature and has a remarkably high enthalpy. In addition, the melted spray coating material travels straight toward the object to be spray coated as the plasma forms a laminer flow. The point at which the plasma is separated can be set anywhere desired within the range of 2.5–3.0 cm from the outlet of torch. Said point can be selected depending upon the shape and size of the object to be spray coated and the required quality of coating film. Accordingly, the application field of the plasma spray coating is remarkably broadened.

As the plasma flame forms a laminer flow and has only a small component of velocity perpendicular to the direction of travel of the plasma flame, the flama sheath covering the plasma flame can take a form of thin straight pipe and the protection of the inner surface thereof is easily performed. In addition, the gas composition of plasma flame can be assuredly controlled by introducing a suitable gas component into the interior of flame sheath, if necessary. Even if modification of the spray coating material, such as oxidation, must be rigorously avoided, as in the case of a metal, the quality control of the resulting coating film can be surely performed. When the exhaust gas is employed the means for separating the plasma, harmful gases generated by plasma formation and most of the spray coating material which did not adhere to the object being spray coated are positively recovered. This recovery, together with the prevention against intense sounds and emission of intense light including ultraviolet rays, can contribute much to the improvement in spray coating-working atmosphere. Thus, the spray coating can be introduced in a series of production without special attached devices as in the case of common machine tool.

DESCRIPTION OF THE PREFERRED EMBODIMENT

Figure 1:
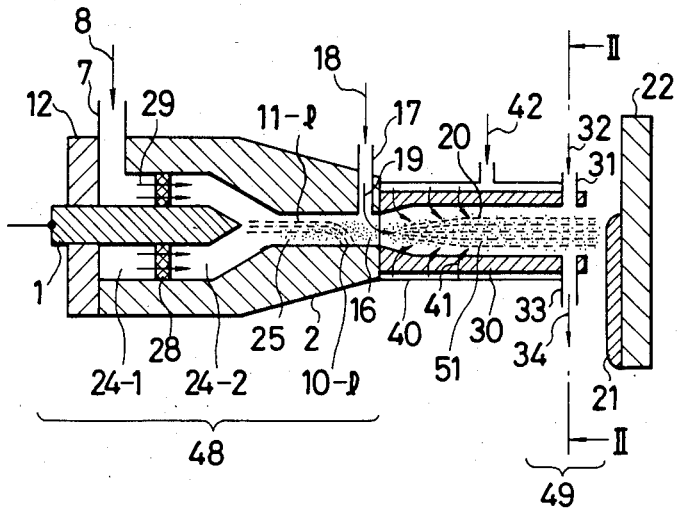
FIG. 1 shows a longitudinal section of a single torch-type plasma spray coating apparatus as one embodiment of this invention.
Figure 2:
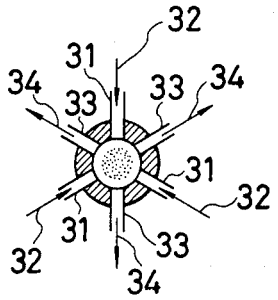
FIG. 2 is a cross-sectional view, taken along the line II—II of FIG. 1, of said embodiment.
Figure 9:
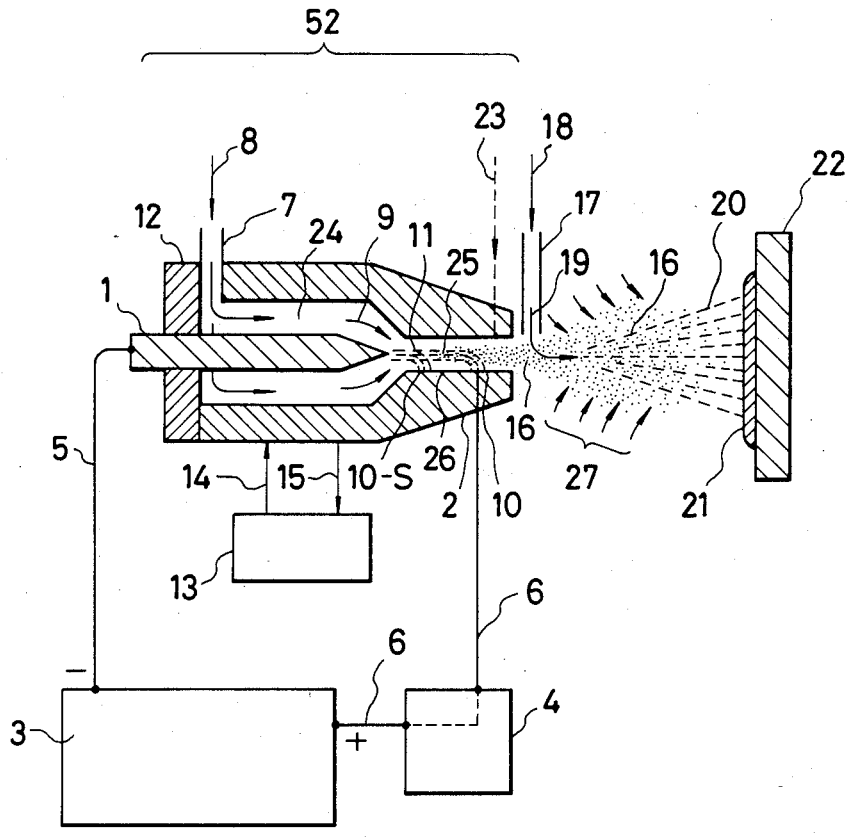
FIG. 9 shows longitudinal section of a prior single torch-type plasma spray coating apparatus.

In FIG. 1, a cathode 1 is so supported by an insulator 12 that the tip of cathode 12 may be placed concentrically with an anodic nozzle 2 with a nozzle channel 25 surrounding the cathode. A plasma gas 8 is fed from a charging port 7 for plasma gas provided in the anodic nozzle 2, as shown by the arrow. In this case, an inert gas, such as argon, helium, nitrogen or hydrogen, is used as plasma gas 8. The anodic nozzle 2 is made of a metal having good thermal conductivity, e.g. copper, and has a double-walled structure. The structure is so constructed that the interior may be cooled by water or the like. With respect to the device or apparatus for cooling the anodic nozzle 2, detailed explanation is omitted here and hereinafter. In addition, although a power source system is connected with cathode 1 and anodic nozzle 2 by a constitution similar to that in the plasma spray coating apparatus of the prior art as shown by FIG. 9, detailed explanation as to the construction thereof is also omitted.

A plasma gas rectifying device which constitutes an important feature of this invention is designated by reference numeral 28 in FIG. 1. This rectifying device is usually constructed of a member capable of rectifying a gas stream, such as porous plate or screen. By virtue of this rectifying device, the plasma gas stream is rectified as shown by arrows 29 and can pass as laminer flow to nozzle channel 25 of anodic nozzle 2 which is constructed so as to be concentric with the tip of cathode 1.

The electric arc 11-1 to be formed in the laminer flow of plasma gas within the nozzle channel 25 of anodic nozzle 2 starts from the tip of cathode 1 and extends along the streamlines of laminer flow about the axis of nozzle channel 25, because the lack of a velocity component in plasma gas directed perpendicular to wall 26 of nozzle channel. The end point of electric arc is formed by contact with wall of nozzle channel, only when a plasma 16 which has been generated from plasma gas by being heated at the surface of the arc gradually grows and contracts with wall of nozzle channel to form a conducting passage.

As the arc 11 which has been formed in the laminer flow of plasma gas in the nozzle channel 25, due to rectifying device 28 arranged upstream in the flow of plasma gas, loses a very large portion of the electric power thereof by heating the plasma gas along the long passage of arc, the wall of nozzle channel is less damaged at the end point of arc, i.e. anode point 10-1. Without cooling the wall 26 of the nozzle channel by feeding a wasteful amount of plasma gas into nozzle channel 25, as in the prior plasma spray coating apparatus, a stable operation can be continued for a long period of time. In addition, despite a relatively small value of the flow rate of plasma gas, the electric arc can be made long. Accordingly, it is possible that the temperature and the enthalpy of generated plasma are made very high.

Figure 6:
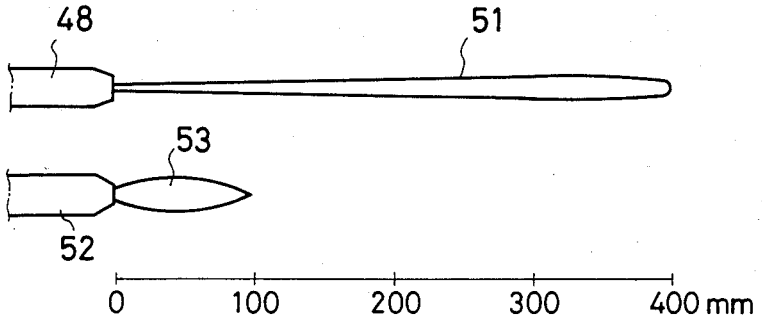
FIG. 6 illustrates the actuation of an apparatus according to this invention, compared with that of a prior apparatus.

Thus, a plasma flame 51 jetted out from the front of the torch 48 forms a laminer flow flame. As this plasma flame 51 involves scarcely any entrained air even after being jetted out from torch 8, the length of plasma flame 51 is large as shown by FIG. 6. Further, the extent of plasma flame 19 is quite limited.

The laminer flow plasma flame 51 according to this invention generates only a low undesired sound of 70–80 phons, whereas a plasma flame 53 from a plasma torch 52 of the prior type generates an intense, undesirable sound of 110–120 phons. This is one of important features of the this invention. In the case when a nozzle having a diameter of 6.4 mm is employed with an input current of 700 amperes and a flow rate of plasma gas of 2.5 l/min., the laminer flow flame jetted into air reaches to the length of about 40 cm as shown in FIG. 6. By way of contrast, a plasma flame from a prior plasma spray coating apparatus having nozzle diameter of the same size actuated by a nearly equal input broadens and has a length less than 10 cm. As elucidated by these facts, the plasma generated by the process according to this invention has a high temperature and a high enthalpy. Consequently, a spray coating material 18 and 19 fed to this plasma flame 51 is rapidly heated to a high temperature. As no entrained air is involved lowering of the plasma flame temperature during travel is markedly less. This is also a remarkable feature of this invention.

However, the jetting speed of plasma 16 has the highest value at the front end of torch 48 and lowers as the traveled distance increases. As the velocity of the entrained spray coating material 18 and 19 also lowers, it is not a wise expedient for forming an excellent coating that the coating material impinges a substrate after a lengthy travel. The means for resolving this contradiction is to provide the apparatus with a means for separating the plasma. This means constitutes one of the important features of this invention.

According to this invention, a stable low-speed plasma flame is generated by the use of a torch which has a rectifying device 28 for forming a laminer flow of plasma gas 8 upstream from the tip of cathode 1 as shown by FIG. 1 and the thus-generated plasma flame is employed for melting a spray coating material 18 and 19. This is a first constituent of this invention. From the laminer flow plasma flame 51 capable of being lengthy, if left as it is, is selectively separated the plasma 16 at a desired point. Immediately thereafter, only the molten material 20 in the form of liquid droplets is sprayed onto the substrate 22 to be treated. This is a second constituent of this invention. The essential in this invention is accomplished by combining this second constituent with the above-mentioned first constituent.

As shown in FIG. 1, the spray coating material 18, which has been fed from material charging pipe 17 to plasma flame, is immediately heated to a high temperature by a strong laminer-flow plasma 16 having a high temperature and a high enthalpy to convert it to a molten material 20. Then, the molten material is entrained by the plasma flame 15 and travels toward a substrate 22 without broadening much. The plasma containing molten material 20 is from the plasma flame 51 by a means 18 for separating the plasma arranged immediately before the object 22 to be treated, i.e. at the point A. Immediately after the separation, the molten material 20 impinges on the substrate 22 to be treated and forms a firm coating 21. The means for separating plasma can be embodied in various ways. The simplest way is to arrange a plasma separating gas feed port 32 from which a plasma separating feed gas is conveyed across plasma flame 51. When an amount of this feed gas 32 is selected so as to be suitable, the plasma 16 is separated from the plasma flame 51 including molten material 20 in the form of liquid droplets. The molten material still retained in molten state is scarcely cooled and impinges on the substrate 32 immediately after separation to form a coating 21. As means for exhausting the gas separated from the plasma 16 a separate plasma gas exhaust port 33 is employable immediately before the substrate 22 to prevent any damage to substrate 16. Further, the separation of plasma 16 can be conducted by the combined use of gas feeding 32 and gas exhausting 34.

In accordance with this invention, the coating material is sufficiently melted with a laminer flow plasma which has a high enthalpy and has a low undesired sound level. Thus, such a high blowing speed of Mach 0.5–3 as that in the prior plasma spray coating with turbulent plasma jet is not required. Nevertheless, a coat is easily obtained which has an adhesive strength and a cohesive strength both of which are the same of the extent as those of a coat the prior plasma spray coating. The temperature distribution in laminer flow plasma is relatively uniform and is not broad, that is, there is no danger that some regions of the substrate are susceptible to impingement of solid particles due to broad variation of temperature. As a result, a coating of excellent uniformity is obtained.

As the laminer flow plasma flame 16 according to this invention, spreads usually not so much, a remarkable improvement in working atmosphere can be realized by virtue of a provision of a flame sheath 30 of refractory material which sheathes the travelling plasma flame, as shown in FIG. 1. Due to the privision thereof, the heat loss from the plasma is decreased and the intense light including intense ultraviolet rays emitted from the plasma are cut off.

In an embodiment of this invention also shown in FIG. 1, the flame sheath 30 or at least a part thereof is made of porous material and, in addition, the flame sheath is covered with a flame sheath mantle 40. A gas is introduced into a cavity between the flame sheath and the flame sheath mantle, as shown by arrow 42, in order to feed said gas in the space of plasma flame 51 through flame sheath 30. Thus, the flame sheath is cooled and the gas composition of the interior is modified. In the case when the apparatus is of small size or like cases, however, the flame sheath 30 and the attachment thereof can be omitted according to this invention.

Figure 3:
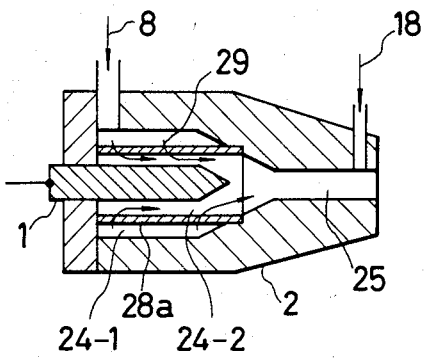
FIG. 3 shows a longitudinal section of a part in another embodiment of this invention.
Figure 4:
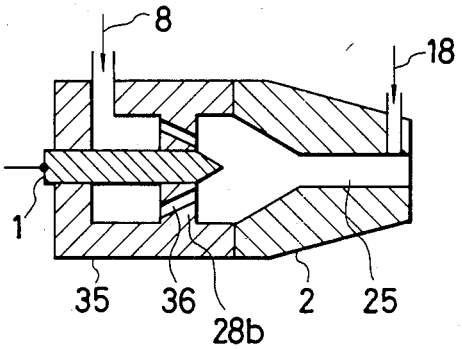
FIG. 4 shows a longitudinal section of the part, corresponding to that in FIG. 3, of a further embodiment of this invention.

The rectifying device for plasma gas disposed in plasma torch as a fundamental constituent of this invention is not limited to a rectifying device 28 composed of a porous disc arranged in the interior of anodic nozzle 2. As shown by FIG. 3, a cylindrical rectifying device **28*a* composed of a permeable member surrounding the cathode 1 having rectifying effect can be employed. Further, a rectifying device 28*b* composed of an insulator provided with guiding canal 36 is also employable as shown in FIG. 4. The guiding canal 36 induces the plasma gas 8 to stream along the tip of cathode as laminer flow. Furthermore, all measures effective for forming a laminer flow of plasma gas 8 in the nozzle channel 25** can be applied.

Figure 5:
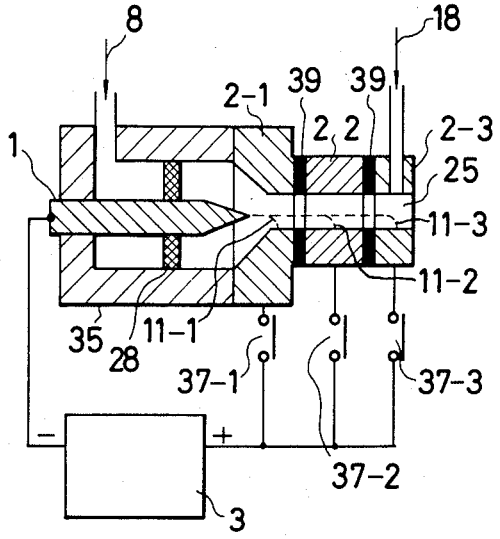
FIG. 5 shows a longitudinal section of a part other than the part in FIG. 3 of a still further embodiment of this invention.

In the method according to this invention, it is a matter of great importance for generating a stable long electric arc in a nozzle channel 25 that a rectifying means 28 is arranged upstream before the nozzle channel for creating a laminer flow of plasma gas. Additionally, it is an effective measure for practicing the method of this invention that an electrically floated part is formed midway in the nozzle channel, as shown in FIG. 5. In the course of stationary operation, the part is employed only during starting and is maintained in the floating state during stationary operation so as to constitute no end point of the arc in said part.

In FIG. 5, the anode consists of three anodic parts 2-1, 2-2 and 2-3 juxtaposed in series via insulator spacers 39. A negative terminal of a power source 3 is connected to anodic parts 2-1, 2-2 and 2-3 via switching means 37-1, 37-2 and 37-3, respectively. To start the apparatus shown in FIG. 5, the power source 3 is introduced while maintaining only the switching means 37-1 closed. A starting electric arc 11-1 is formed from the tip of cathode 1 toward the anodic part 2-1 as depicted in FIG. 5. In this state, the plasma gas is heated and plasma is formed by arc 11-1 emitted outward through nozzle channel 25. Thereupon, the switching means 37-2 is closed simultaneously with opening the switching means 37-1. As a result, a starting arc 11-2 is formed and said starting arc 11-1 disappears.

Next, when the switching means 37-3 is closed in this state and the switching means 37-2 is simultaneously opened, a starting arc 11-3 is formed and the starting arc 11-2 disappears. In this state the condition is accomplished wherein the longest plasma is being formed in the nozzle channel. AT this stage, both anodic parts 2-1 and 2-2 are in the electrically floated state as both of switching means 37-1 and 37-2 are opened. The arc which starts from the tip of cathode 1 is fixed exclusively at the third anodic part 2-3 to form a stable electric arc, because the arc cannot end at any of two electrodes 2-2 and 2-2 . These situations together with the fact that plasma flame travelling in nozzle channel 25 being of a laminer flow ensures the realization of a stable, long electric arc in nozzle channel 25.

Additionally, although two anodic parts 2-1 and 2-2 are in electrically floating state in the usual operation of the embodiment shown in FIG. 5, this invention is not limited to the embodiments having two floating anodic parts.

Figure 7:
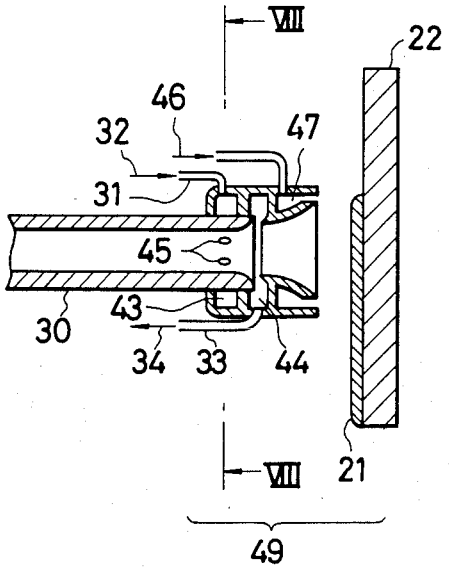
FIG. 7 shows a longitudinal section of a part other than the part in FIG. 5 of yet another embodiment of this invention.
Figure 8:
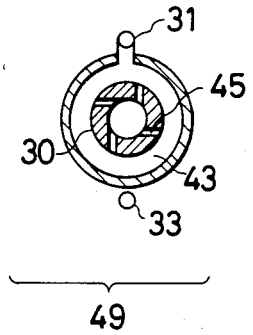
FIG. 8 is a cross-sectional view, taken along the line III—III of FIG. 7.

FIG. 7 represent, in detail an embodiment of plasma separating means which is diposed in the proximity of a substrate 22 to be treated by the plasma spray coating apparatus according to this invention as shown by FIG. 7. Generally, in a plasma separating means, a plasma separating feed gas 32 is not always blown perpendicular to the central axis of a plasma flame. In some cases, it is favorable that the plasma separating feed gas is blown to form an oblique angle with the flor direction of the plasma flame. The angle to be employed depends on the size of plasma flame, the amount of gas plasma etc.

In addition, it is more effective in some cases that a plasma separating feed gas 32 be preliminarily blown into an annular chamber 43 for the plasma separating feed gas, arranged in the proximity of a substrate 22 to be worked and then the plasma separating feed gas 32 be blown to the peripheral part of plasma flame through gas feeding holes 45 having a component tangential to plasma flame, especially for effective action of plasma separation, as shown in FIG. 7. This embodiment is preferred especially for separating a spray coating material having low melting temperature from the line 22 peripheral part of plasma flame or the unmelted spray coating material together with the plasma. In this case, when an annular chamber 44 for plasma separating exhaust gas is provided downstream, the plasma separating gas feeding holes 45 and a plasma separating exhaust 34 are permitted to run in the direction as shown by arrow, the apparatus can be operated without discharging unmelted spray coating material, plasma gas exhaust etc. out of the system. This is also one important feature of this invention. Additionally, the spray coating material travels through a very short distance immediately after leaving the plasma separating means and impinges on the object to be worked to form a firm coating, in accordance with this invention. Thus, the plasma flame is securely prevented from mixing with impurity gases by the effect of the flame sheath 30 and the sealing action thereof. This is also a feature of the method according to this invention. Further, the flame sheath 30 can be made relatively thin as the plasma forms a laminer flow flame. This is quite favorable in the procedure of operation. In order to prevent positively any further oxidation due to mixing of air which would be brought about between the front end of the spray coating apparatus and the substrate to be worked, an annular chamber 47 for protective gas is arranged proximate to the substrate 22 to be worked. By means of feeding an inert gas or the like to said annular chamber as shown by arrow 46, oxidation or other undesired reactions which will take place by contact of air with the molten spray coating material traveling toward the substrate to be worked can be inhibited. Embodiments of this invention are not limited to those respectively shown in FIGS. 1, 2, 3, 4, 7 and 8. But, all embodiments based on the technical concepts of this invention can be practiced. As for plasma separating means, there is a case wherein the provision of only a gas feed port enables the separation of plasma. The direction of gas feed for separating plasma can be determined to be suitable, on the basis of the technical concepts according to this invention. As plasma separating means is employable a mere exhausting system. In addition, as plasma separating system is also employable a combination of feeding and exhausting both of gas. The selection of these means may be suitably performed depending on the object of use, the size of plasma flame, the amount of gases, etc.

The flame sheath is not always employed when the apparatus is small. However, the common use of flame sheath in an apparatus of large size can cut off an intense light including ultraviolet rays emitted from plasma flame along with preventing more effectively the lowering of temperature of the plasma flame. The use of a thermal insulation layer or a cooling device outside of the flame sheath is preferred in most cases. But these are not shown in the accompanying drawings.

The apparatus according to this invention presents excellent characteristics, such as low undesired sound, high strength and low operating cost, when operated within the limiting conditions for forming a laminer flow plasma flame. When it is desired that a porous coating film be formed at a high speed by changing the operating conditions, the apparatus can be operated somewhat beyond the limiting conditions for laminer flow, i.e. in the range of subturbulent flow.

Since this invention is as detailed above, the first effect of this invention consists in the improvement in the working atmosphere. While an undesired sound of the extent of 110–120 phons is generated by plasma spray coating apparatus of the prior art, that of this invention generates usually an undesired sound of merely the extent of 70–80 phons. In addition, while the plasma spray coating apparatus of the prior art generates an intensely bright light including ultraviolet rays, no bright flame is emitted by the apparatus of this invention. Thus, the operation can be conducted without putting on protective goggles in most cases. When a plasma separation exhaust port is used as means for separating plasma, the gas generated by the plasma spray coating and the unmelted coating material are directly recovered at the outlet of the apparatus. Consequently, there is no contamination of the environment by exhaust and flying particles of unmelted spray coating material and the spray coating can be practiced in good surroundings. The practice of plasma spray coating becomes easy work in surroundings as fine as that in the case of common machine tools. In the case of the plasma spray coating apparatus, the apparatus is installed in a sound isolating room and only the operator equipped with sound insulator means and glare shield goggles can operate the apparatus. Thus, such an apparatus cannot be arranged in a common production line. By virtue of this invention, a plasma spray coating apparatus can be installed as common processing machine in a common production line without the provision of special facilities, such as isolating chamber.

A plasma spray coating film obtained by the plasma spray coating method and the apparatus therefor has a strength equal to or 1.5 times the strength of the coating film obtained by the prior plasma spray coating apparatus. The improvement is remarkable also from this viewpoint.

In the spray coating method and the apparatus therefor according to this invention, the speed of plasma gas to be blown on the substrate is conspicuously low, and only a small portion of plasma gas and droplets of molten material impinge directly on the substrate. The substrate is not subject to high power. Thus, the spray coating method of this invention can be applied to a substrate having a relatively low strength. As the plasma beam can be throttled to make it thinner, a delicate working can be practiced. In the plasma spray coating apparatus in accordance with this invention, wear of the apparatus is low as the place corresponding to the end of the arc is cooled and securely protected by a protecting gas. Continuous operation for a long period of time can be poerformed with ease. In addition, the starting characteristic is stable for long time and the start-stop actuation can be performed easily and soundly.

What is claimed is:

1. A single torch-type plasma spray coating apparatus for coating articles, said apparatus having an arc torch for generating a plasma flame, a charging port for plasma gas, a cathode and an anodic nozzle, said apparatus comprising a plasma gas rectifying device arranged upstream from the tip of said cathode for converting the plasma gas and plasma flame flowing from said anodic nozzle into a laminar flow, means for feeding a spray coating material into the plasma flame at a point near the outlet of said arc torch, means surrounding and confining said plasma gas, plasma flame and material during a travel interval long enough to melt the material component thereof, said means terminating adjacent the article to be coated, and means for separating the plasma gas component from the plasma flame and melted entrained material, said departing means being an exhausting port for absorbing gas from the plasma flame, said separating means being at the end of said surrounding means and immediately before the plasma flame and entrained material impacts the article to be coated.

2. A single torch-type plasma spray coating apparatus according to claim 1 wherein said means for separating the plasma gas component includes a charging port immediately preceding the end of the surrounding means for blowing a gas into the plasma flame.

3. A single torch-type plasma spray coating apparatus according to claim 1 wherein a combination of a gas charging port and a gas exhausting port is employed as said means for separating the plasma gas component.

4. A single torch-type plasma spray coating apparatus according to claim 1 wherein a combination of a gas charging port and a gas exhausting port is employed as said means for separating plasma.

5. A single torch-type plasma spray coating apparatus according to claim 4 wherein the plasma flame between the outlet of arc torch and means for separating plasma is surrounded by a flame sheath.

6. A single torch-type plasma spray coating apparatus according to anyone of claims 2, 3, wherein a flame sheath surrounds said flame plasma between said material feeding means and said gas plasma separating means, at least a part of said flame sheath being composed of porous material and means for feeding gas through said flame sheath is provided.

7. A single torch-type plasma spray coating apparatus for coating articles, said apparatus having an arc torch for generating a plasma flame consisting of a charging port for plasma gas, a cathode and an anodic nozzle, said apparatus comprising a plasma gas rectifying device arranged upstream from the tip of said cathode for converting the plasma flame flowing from said anodic nozzle into a laminar flow, means for feeding a spray coating material to the plasma flame at a point the outlet of said arc torch, and means for separating the plasma gas component from the plasma flame and entrained material, said means being arranged downstream of the plasma flame immediately before the plasma flame impacts the article to be coated, a sheath surrounding the plasma flame between the outlet of arc torch and said plasma gas component separating means; at least a portion of said flame sheath being composed of porous material and means for feeding gas through said sheath.

8. A single torch-type plasma spray coating apparatus according to claim 7 in which the interior wall of said flame sheath is composed of refractory material.

9. A single torch-type plasma spray coating method including the steps of feeding a plasma gas to a plasma gas rectifying means arranged upstream from the plasma flame generating anodic nozzle of an arc torch, generating a plasma flame having a laminar flow from said anodic nozzle toward an object to be coated, feeding a spray coating material into the laminar flow plasma flame at a point near the outlet of said anodic nozzle to melt said material, confining the laminar flow plasma flame in a sheath at least a portion of which is gas porous and introducing gas into the laminar flow plasma flame through the sheath, separating the plasma gas component from the laminar flow plasma flame after it leaves the sheath and immediately before the object to be coated, and permitting the spray coating material in molten state to be deposited on the object to be coated.

10. A single torch-type plasma spray coating apparatus having an arc torch for generating a plasma flame, a charging port for plasma gas, a cathode and an anodic nozzle, said apparatus comprising a plasma gas rectifying means arranged upstream from the tip of said cathode for converting a plasma flame flowing out of said anodic nozzle into a laminar flow, means for feeding a spray coating material to the plasma flame at a point near the outlet of said arc torch, sheath means having gas porosity surrounding said laminar flow of plasma flame and coating material to a point adjacent the object to be coated and supply means for gas to be passed through said sheath into said laminar flow plasma flame, and means for separating the gas plasma component from the coating material and plasma flame components immediately before the object to be coated.

11. A single torch-type plasma spray coating apparatus according to claim 10, which is characterized by being provided with a member arranged between the cathode and the anodic nozzle, which member is maintained in electrically floating state at least for stationary operation.

12. A single torch-type plasma spray coating apparatus according to claim 10 wherein said means for separating the gas plasma component from the flame and material plasma component is a charging port for blowing a gas into the plasma flame.

13. A single torch-type plasma spray coating apparatus according to claim 10 wherein said means for separating the gas plasma component from the flame and material plasma component is an exhausting port for withdrawing gas from plasma flame.

14. A single torch-type plasma spray coating apparatus according to claim 10 wherein the combination of a gas charging port and a gas exhausting port is employed as said means for separating the gas plasma component from the flame and material plasma component.

15. A single torch-type plasma spray coating apparatus as described in claim 1 wherein said separating means is means to direct a stream of gas directed through said plasma flame at a right angle thereto.

16. A single torch-type plasma spray coating apparatus as described in claim 1 wherein said separating means includes a nozzle for discharging a stream of gas on one side of said plasma flame and an element on the opposite side of said plasma flame for withdrawing the combination of said stream of gas and the gaseious component of the plasma from said plasma flame.

17. A single torch-type plasma spray coating apparatus for coating articles, said apparatus having an arc torch for generating a plasma flame, a charging port for plasma gas, a cathode and an anodic nozzle, said apparatus comprising a plasma gas rectifying means arranged upstream from the tip of said cathode for converting the plasma gas and plasma flame flowing from said anodic nozzle into a laminar flow, means for feeding a spray coating material into the plasma flame at a point near the outlet of said arc torch, means surrounding and confining said plasma gas, plasma flame and material during a travel interval long enough to melt the material component thereof, said confining means terminating adjacent the article to be coated, and means for separating the plasma gas component from the melted entrained material, said means being adjacent the discharge end of said confining means and immediately before the plasma flame and entrained material impacts the article to be coated, said separating means being ports in the side of the confining means directing a gaseous component into the stream of the plasma gas flame and entrained material.

18. A single torch-type plasma spray coating apparatus as described in claim 17 wherein said gas directing means directs the stream of gas through said plasma flame at a right angle thereto.

19. A single torch-type plasma spray coating apparatus as described in claim 17 wherein said gas directing means directs the stream of gas tangentially into said plasma flame.

* * * * *

UNITED STATES PATENT AND TRADEMARK OFFICE

CERTIFICATE OF CORRECTION

PATENT NO. : 4,741,286

DATED : May 3, 1988

INVENTOR(S) : Tsutomu Itoh et al

It is certified that error appears in the above-identified patent and that said Letters Patent is hereby corrected as shown below:

Column 3, Line 13:
"travles" should be -- travels --.

Column 3, Line 22:
after "flame" insert -- by --.

Column 4, Line 32:
"the should be -- an --.

Column 4, Line 65:
"flama" should be -- flame --.

Column 5, Line 7:
after "employed" insert -- as --.

Column 5, Line 16:
after "production" insert -- steps --.

UNITED STATES PATENT AND TRADEMARK OFFICE

CERTIFICATE OF CORRECTION

PATENT NO. : 4,741,286

DATED : May 3, 1988

INVENTOR(S) : Tsutomu Itoh et al

It is certified that error appears in the above-identified patent and that said Letters Patent is hereby corrected as shown below:

Column 5, Line 40:
"line III-III" should be -- line VIII-VIII --.

Column 6, Line 6:
"11-1" should be -- 11-ℓ --.

Column 6, Line 44:
after "one of" insert -- the --.

Column 6, Line 45:
after"features of" delete -- the --.

Column 7, Line 25:
after "plasma" insert -- 16 --.

Column 7, Line 43:
"employable" should be -- employed --.

UNITED STATES PATENT AND TRADEMARK OFFICE

CERTIFICATE OF CORRECTION

PATENT NO. : 4,741,286

DATED : May 3, 1988

INVENTOR(S) : Tsutomu Itoh et al

It is certified that error appears in the above-identified patent and that said Letters Patent is hereby corrected as shown below:

Column 7, Line 55:
after "coat" insert -- by --.

Column 7, Line 67:
"privision" should be -- provision --.

Column 8, Line 61:
"AT" should be -- At --.

Column 8, Line 67:
"2-2" should be -- 2-1 --.

Column 9, Line 8:
"represent" should be -- represents --.

Column 9, Line 16:
"flor" should be -- flow --.

UNITED STATES PATENT AND TRADEMARK OFFICE

CERTIFICATE OF CORRECTION

PATENT NO. : 4,741,286

DATED : May 3, 1988

INVENTOR(S) : Tsutomu Itoh et al

It is certified that error appears in the above-identified patent and that said Letters Patent is hereby corrected as shown below:

Column 9, Line 30:
After "the" omit -- line 22 --.

Column 10, Line 59:
"strangth" should be -- strength --.

Column 11, Line 9:
"poerformed" should be -- performed --.

Column 11, Claim 1, Line 29:
"departing" should be -- separating --.

Column 11, Claim 7, Line 67:
after "point" insert -- near --.

Column 13, Claim 16, Line 8:
"gaseious" should be -- gaseous --.

Signed and Sealed this

Seventh Day of February, 1989

*Attest:*

*Attesting Officer*

DONALD J. QUIGG

*Commissioner of Patents and Trademarks*